United States Patent [19]

Satomi et al.

[11] Patent Number: 4,770,145

[45] Date of Patent: Sep. 13, 1988

[54] ROTARY VALVE ASSEMBLY FOR BOOSTING TYPE FUEL INJECTION

[75] Inventors: Yu Satomi; Hikozaburo Hiraki, both of Oyama, Japan

[73] Assignee: Kabushiki Kaisha Komatsu Seisakusho, Tokyo, Japan

[21] Appl. No.: 31,226

[22] Filed: Mar. 30, 1987

Related U.S. Application Data

[63] Continuation of Ser. No. 505,242, Jun. 17, 1983, abandoned.

[30] Foreign Application Priority Data

Jun. 22, 1982 [JP] Japan ..... 57-92427[U]

[51] Int. Cl.[4] ..... F02M 39/00

[52] U.S. Cl. ..... 123/447; 123/450; 123/467; 417/462

[58] Field of Search ..... 123/450, 467, 446, 447; 417/462

[56] References Cited

U.S. PATENT DOCUMENTS 3,416,506 12/1968 Steiger ..... 123/467

4,407,250 10/1983 Eheim ..... 123/450

4,440,134 4/1984 Nakao ..... 123/447

FOREIGN PATENT DOCUMENTS 57-188762 11/1982 Japan ..... 123/450

*Primary Examiner*—Carl Stuart Miller

*Attorney, Agent, or Firm*—Armstrong, Nikaido, Marmelstein & Kubovcik

[57] ABSTRACT

A rotary valve assembly for fuel injectors which can effectively prevent highly pressurized drain waves from propagating into an extended metering groove. The assembly comprises a cylindrical housing having a plurality of fuel ports formed in the cylindrical wall and a metering port formed in the end wall, each of the fuel ports being connected with respective fuel injectors, and a rotary spool rotatably mounted within the housing defining a metering chamber between one end face thereof and the end wall of the housing. The rotary spool has formed therein a fuel supply passage connected at one end with a fuel supply source and at the other end selectively connectible with either one of the fuel ports. The rotary spool further has formed therein an extended metering groove and a drain groove spaced circumferencially from the metering groove.

3 Claims, 2 Drawing Sheets

ROTARY VALVE ASSEMBLY FOR BOOSTING TYPE FUEL INJECTION

This application is a continuation of application Ser. No. 505,242 filed June 17, 1983, now abandoned.

BACKGROUND OF THE INVENTION

This invention relates to a rotary valve assembly for a boosting type unit injector.

In a prior art assembly, with the rotation of a spool of a rotary valve, a fuel supply port open at the outer periphery of the spool is successively communicated with ports of the rotary valve each connected to the boosting type unit injector for each cylinder, whereby fuel is supplied from a fuel passage in the spool to each injector.

The outer periphery of the spool is formed with a drain groove communicating with a drain passage. The drain groove communicates with fuel supply ports each communicating with a boosting piston chamber of each boosting type unit injector, so that fuel after the operation of each unit injector is drained through the drain groove.

In the prior art, however, the drain groove of the rotary valve also serves as a metering groove. Therefore, when a boosting piston chamber is suddenly opened, high pressure fuel therein forms an impulsive wave to adversely affect other injectors during a metering stroke, thus resulting in instable metering.

SUMMARY OF THE INVENTION

It is therefore an object of the present invention to provide a rotary valve assembly for a boosting type unit injector which can prevent high pressure drain waves from being propagated into a metering groove.

Another object of the present invention is to provide a rotary valve assembly for a boosting type unit injector which can attenuate the drain waves from the unit injectors so that the precision of metering can be improved.

In accordance with an aspect of the present invention, there is provided a rotary valve assembly in a fuel injection system for an internal combustion engine including a pressurized fuel supply source, a plurality of fuel injectors and fuel metering means, said rotary valve assembly comprising: a cylindrical housing having a cylindrical wall and an end wall, said cylindrical housing having a plurality of first ports formed in the cylindrical wall and a second port formed in the end wall, each of said first ports being connected with said respective fuel injectors and said second port being connected with said metering means; a rotary spool rotatably mounted within said cylindrical housing defining a metering chamber between an end face of said spool and the end wall of said cylindrical housing, said metering chamber being in constant communication with said metering means through said second port, said spool having formed therein a fuel supply passage connected at one end with said pressurized fuel supply source and at the other end selectively connectible with either one of said first ports as said rotary spool rotates within said housing; an extended metering groove formed circumferentially in said rotary spool, said metering groove being in constant communication with said metering chamber and in selective communication with said first ports; and a drain groove formed in said rotary spool spaced circumferencially from said extended metering groove and in alignment therewith, said drain groove being in constant communication with said metering chamber and in selective communication with said first ports.

The above and other objects, features and advantages of the present invention will be readily apparent from the following description taken in conjunction with the accompanying drawings.

DESCRIPTION OF THE PREFEERRED EMBODIMENTS

The present invention will now be described in detail with reference to accompanying drawings.

Figure 1:
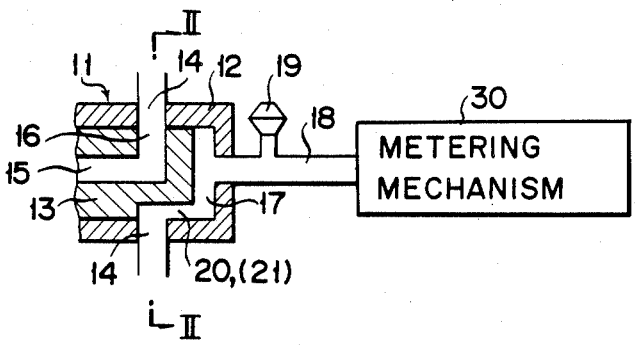
FIG. 1 is a longitudinal sectional view showing essential parts of a rotary valve assembly according to the present invention.
Figure 2:
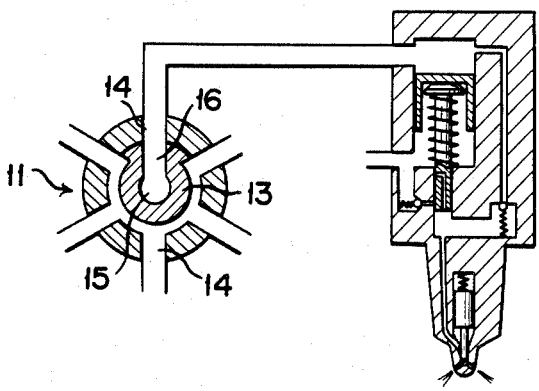
FIG. 2 is a sectional view taken along the line II—II of FIG. 1 together with a boosting type unit injector which is also sectioned.

Referring to the Figures, reference numeral 11 designates a rotary valve. The rotary valve 11 has a valve body 12 accommodating a rotary spool 13 fitted therein. The spool 13 has a fuel passage 15 and a fuel supply port 16 communicating therewith. A metering pressure chamber 17 is defined between one end wall of the valve body 12 and the corresponding end of the spool 13. The metering pressure chamber 17 is connected through a passage 18 to a metering mechanism 30 of the rotary valve 11. A damper 19 is provided in the passage 18. Suitable apparatus for the metering mechanism, indicated in FIG. 1 by the numeral 30, as shown and described in co-pending U.S. patent application Ser. No. 378,180, filed May 14, 1982, now issued on Apr. 3, 1984, as U.S. Pat. No. 4,440,134, and assigned to the assignee as the assignee of this application. The principle elements of such a system include a high pressure pump to deliver fuel from a fuel tank at a high pressure to a high pressure accumulator and then to a rotary valve the rotary valve is driven in synchronism with the cam shaft of the engine so as to dispense or supply the fuel under a high pressure from the accumulator into one or more fuel injectors.

The spool 13 has an extended metering groove 20 and a drain groove 21 formed separately in its outer periphery. The metering groove 20 and the drain groove 21 each extend to and communicate with the metering pressure chamber 17.

Figure 3:
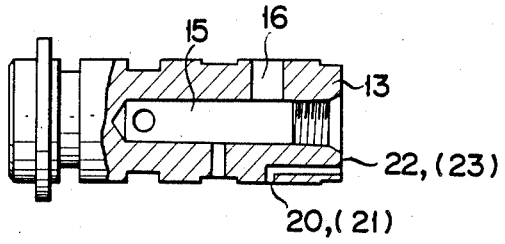
FIG. 3 is a side view, partly in section, of another embodiment of the rotary spool.
Figure 4:
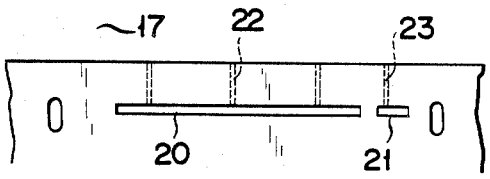
FIG. 4 is a fragmentary development view of the rotary spool of FIG. 3 showing relative positions of a metering groove and a drain groove.

In another embodiment shown in FIG. 3, the metering groove 20 is communicated with the metering pressure chamber 17 through a plurality of communicating holes 22 while the drain groove 21 is communicated with the metering pressure chamber 17 through another communicating hole 23. The metering groove 20 and the drain groove 21 of this embodiment are developed as shown in FIG. 4. Of the ports 14 formed in the valve body 12 except one port functioning as fuel supply port, all remaining ports 14 function as drain ports. With the rotation of the rotary spool 13, these drain ports 14 communicate with the metering groove 20 and the drain groove 21.

With the drain groove 21 and metering groove 20 provided separately, high drain pressure waves will not be propagated into the metering groove 20.

The damper 19 also attenuates the drain pressure waves.

Figure 5:
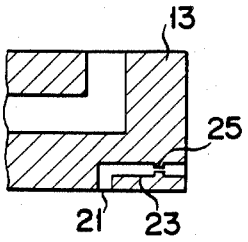
FIG. 5 is a longitudinal sectional view, partly broken away, of still another embodiment of the rotary spool.

FIG. 5 shows a modification, in which a communicating hole 23 has a throttle or orifice 25 for increasing the attenuation of drain pressure waves.

As has been described in the foregoing, according to the invention, the metering pressure chamber 17 is provided between an end of the valve body 12 and the corresponding end of the spool 13, the damper 19 is provided for the metering chamber 17, the metering groove 20 and drain groove 21 are formed separately in the outer periphery of the spool 13, with the metering groove 20 communicated with the metering pressure chamber 17 through the communicating holes 22 and the drain groove 21 communicated with the metering pressure chamber through the communicating hole 23. Thus, it is possible to prevent high pressure drain waves from being propagated into the metering groove 20 and also attenuate the drain waves with the damper 19, thus permitting improvement of the precision of metering.

What is claimed is:

1. In a fuel injection system for an internal combustion engine including a pressurized fuel supply source, a plurality of fuel injectors and fuel metering means, a rotary valve assembly, comprising:

a cylindrical housing having a cylindrical wall and an end wall, said cylindrical housing having a plurality of first ports formed in the cylindrical wall and a second port formed in the end wall, each of said first ports being connected with said respective fuel injectors and said second port being connected with said metering means;

a rotary spool rotatably mounted within said cylindrical housing defining a metering pressure chamber between an end face of said spool and the end wall of said cylindrical housing, said metering pressure chamber being in constant communication with said metering means through said second port, said spool having formed therein a fuel supply passage connected at one end with said pressurized fuel supply source and at the other end selectively connectible with one of said first ports as said rotary spool rotates within said housing:

an extended metering groove formed circumferentially in said rotary spool, said metering groove being in constant communication with said metering pressure chamber and in selective communication with said first ports;

a drain groove formed in said rotary spool sapced circumferentially from said extended metering groove and in alignment therewith, said drain groove being in constant communication with said metering pressure chamber and in selective communication with said first ports;

conduit means for connecting said metering pressure chamber with said metering means; and damper means provided in said conduit means, whereby said damper means attenuates changes in pressure during metering of fuel to said engine.

2. A rotary valve assembly according to claim 1 wherein said extended metering groove is communicated with said metering pressure chamber through a plurality of first passages and said drain groove is communicated with said metering pressure chamber through a second passage.

3. A rotary valve assembly according to claim 2 further comprising a restrictor formed in said second passage.

* * * * *